US007311528B2

(12) United States Patent
Jiten

(10) Patent No.: US 7,311,528 B2
(45) Date of Patent: Dec. 25, 2007

(54) IC SOCKET

(75) Inventor: Hirotaka Jiten, Osaka (JP)

(73) Assignee: ESPEC Corp., Osaka (JP)

( * ) Notice: Subject to any disclaimer, the term of this patent is extended or adjusted under 35 U.S.C. 154(b) by 0 days.

(21) Appl. No.: 11/406,385

(22) Filed: Apr. 19, 2006

(65) Prior Publication Data

US 2006/0240686 A1 Oct. 26, 2006

(30) Foreign Application Priority Data

Apr. 20, 2005 (JP) ..... 2005-122953
Mar. 1, 2006 (JP) ..... 2006-055429

(51) Int. Cl.
*H01R 12/00* (2006.01)

(52) U.S. Cl. ..... 439/70

(58) Field of Classification Search ..... 439/66, 439/70, 81, 700

See application file for complete search history.

(56) References Cited

U.S. PATENT DOCUMENTS 6,746,252 B1 * 6/2004 Scott ..... 439/70
6,846,184 B2 * 1/2005 Fan et al. ..... 439/66
6,937,045 B2 * 8/2005 Sinclair ..... 324/761
2001/0023140 A1 9/2001 Saijo et al.
2004/0266272 A1 * 12/2004 Maruyama et al. ..... 439/700

FOREIGN PATENT DOCUMENTS

JP 2001-267029 9/2001

* cited by examiner

*Primary Examiner*—Phuong Dinh
(74) *Attorney, Agent, or Firm*—Harness, Dickey & Pierce, P.L.C.

(57) ABSTRACT

An IC socket comprises a plurality of conductive connecting sections each having a holding section for holding one of a plurality of lead terminals of an IC; and a plurality of conductive coil springs, which are protruded from the IC socket and respectively fixed to the conductive connecting sections, the conductive springs being closer to a circuit board than the conductive connecting sections.

13 Claims, 14 Drawing Sheets

IC SOCKET

This Nonprovisional application claims priority under 35 U.S.C. § 119(a) on Patent Application No. 122953/2005 filed in Japan on Apr. 20, 2005, and No. 55429/2006 filed in Japan on Mar. 1, 2006, the entire contents of which are hereby incorporated by reference.

FIELD OF THE INVENTION

The present invention relates to an IC socket for connecting a plurality of lead terminals of an IC into an electrode of a circuit board. The present invention is particularly applicable to an IC socket requiring resistance to high temperature.

BACKGROUND OF THE INVENTION

An IC socket has been conventionally used for electrically connecting a lead terminal protruded from an IC to a circuit board. With the IC socket, the electrical conduction between an IC and a circuit board was conventionally established by soldering a contact pin protruded from an IC socket into the circuit board through a hole formed on the circuit board, or by directly soldering the contact pin to electric wire of the circuit board.

Here, the IC socket is an expendable item, and therefore may be needed to be replaced. In the replacement, the IC socket thus soldered into the circuit board needs to be melted again to be removed from the circuit board, which complicates the replacement process.

In the field of IC socket, there is a demand for an IC socket capable of electrical conduction between the IC and circuit board under a high temperature, for example, under 400° C. Such an IC socket is however not suitably connected to a general circuit board which is not heat resistant. A circuit board of ceramic may be suitable, but a ceramic circuit board is expensive and limited in size, approximately 200 mm square at the maximum. Further, even if a ceramic circuit board is used, it cannot be soldered under 400° C. Then, the circuit board needs to be welded by silver or electrically, but this is expensive because of the large number of connection portions in a narrow pitch. Moreover, an IC socket welded to a contact pin by silver or by an electrical manner will not be easily replaced.

To make the replacement easier, a particular IC socket (IC socket 100), which is shown in FIG. 15, is available in the market, which allows a lead terminal 112 protruded from an IC 111 to be electrically conducted to a pad 121 of a circuit board 120. The circuit board connected to this IC socket 100 is a metal board coated with ceramic or the like, and a contact pin is provided in contact with a pad printed on the ceramic surface.

More specifically, as shown in FIG. 15, a contact pin 102 made of a conductive material is buried in a through hole 101 which penetrates through the IC socket 100. The upper half of the contact pin 102 is a holding section 102*a* for holding the lead terminal 112 protruded from the IC 111. The lower half of the contact pin 102 is a projection section 102*b* which is protruded from the IC socket 100. The front edge of each of the projection sections 102*b* of plural contact pins 102 is brought into contact with a pad 121 of the circuit board 120 by connecting a bis 103 into the circuit board 120 through the IC socket 100. With this structure, the welding by silver or in an electrical manner is not necessary, and the IC socket 100 can be easily replaced.

However, in this arrangement, it is difficult to ensure the even contacts of the entire projection sections 102*b* into the pad 121 of the circuit board 120, and therefore may cause contact failure.

As one example of technique made in view of this problem, Japanese Laid-Open Patent Application Tokukai 2001-267029 (published on Sep. 28, 2001) discloses a structure in which the contact pin is given some elastic force by a spring so as to ensure its contact with the circuit board.

To more specifically explain the IC socket of Japanese Laid-Open Patent Application Tokukai 2001-267029 (published on Sep. 28, 2001), as shown in FIG. 16, the IC socket 200 includes a contact pin 230 in a socket body 201, and this contact pin 230 connects a solder ball 211 of an IC package 210 and a pad 221 of a circuit board 220.

The contact pin 230 includes a sleeve 231, a plunger 232, and a coil spring 233. The sleeve 231 has a large outer diameter section 231*a* which is enlarged in outer diameter. The plunger 232 is inserted into the sleeve 231 from the bottom of the sleeve 231, and vertically moves inside the sleeve 231. The coil spring 233 gives an upward elastic force to the sleeve 231 while giving a downward elastic force to the plunger 232. The sleeve 231 is vertically movable with respect to the socket body 201, and a ball contact section 234 on the upper section of the sleeve 231 is brought into contact with the solder ball 211 to establish electrical conduction therebetween. The lower end of the plunger 232 is brought into contact with the pad 221 of the circuit board 220 to establish electrical conduction therebetween.

With this arrangement, the IC socket 200 avoids the defect that some of the plural contact pins 230 fail to be brought into contact with the pad 221 of the circuit board 220, which would result in contact failure.

However, in the IC socket disclosed in Japanese Laid-Open Patent Application Tokukai 2001-267029 (published on Sep. 28, 2001), only a small portion (point) of the lower edge of the plunger 232 is in contact with the pad 221 of the circuit board 220; therefore, there still is a possibility of contact failure particularly in the case where the plunger 232 is deformed by heat, or in the case where an oxide film is generated between the pad 221 and the plunger 232.

SUMMARY OF THE INVENTION

An object of the present invention is to provide an IC socket which can be easily replaced, and securely prevents inadequate conduction with the circuit board.

In order to achieve the foregoing object, an IC socket according to the present invention comprises: a plurality of conductive connecting sections each having a holding section for holding one of a plurality of lead terminals of an IC; and a plurality of conductive springs, which are protruded from the IC socket and respectively fixed to the conductive connecting sections, the conductive springs being closer to a circuit board than the conductive connecting sections.

With this invention, each of the plural lead terminals of the IC is, for example, inserted into the holding section of the conductive connecting section of the IC socket, so that the lead terminals are respectively held by the holding sections. Further, since each of the conductive connecting section includes a spring, which is fixed thereto and protruded therefrom toward the circuit board, the electrode of the circuit board can be brought into contact with the spring by some pushing force, thereby bringing the electrode into contact with the spring by an elastic force.

With this arrangement, even if the IC socket includes plural springs with varied lengths, all of the springs are securely come in contact with the electrode of the circuit board.

Moreover, the entire end of the spring is brought into contact with the electrode if it is moved by an elastic force of the spring, and therefore the connection failure of the entire device is very unlikely to occur. Further, the electric resistance between the IC socket and the electrode is small when they are connected.

Further, in the foregoing IC socket, the spring is pressed into the electrode of the circuit board without welding by silver (Ag) or in an electric manner. The IC socket can be therefore easily replaced.

On this account, the IC socket of the present invention allows easy replacement, and also is immune to the problem of inadequate contact with the circuit board.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 1(*b*) is a magnified view of a main part of the IC socket, showing structures of a contact pin and a coil spring.

FIG. 4(*b*) is a cross-sectional view, taken along the line Y-Y of FIG. 4(*a*), showing a structure of the IC socket.

FIG. 4(*c*) is a magnified view of a main part of the IC socket, showing a mounting state of a contact pin and a coil spring.

FIG. 8(*b*) is a front view of a variation of coil spring.

FIG. 9(*b*) is a lateral view of the contact pin partly reduced in width.

FIG. 13(*b*) is a magnified view of a main part of the IC socket of FIG. 13(*a*), showing structures of a contact pin, a coil spring, and a column member.

FIG. 14(*b*) is a bottom view of the IC socket of FIG. 14(*a*), viewed from the side of the circuit board.

FIG. 14(*c*) is a magnified view of a main part of the IC socket, showing a state where the coil spring is contracted with the column member in contact with a pad.

DESCRIPTION OF THE EMBODIMENTS

First Embodiment

One embodiment of the present invention is described below with reference to FIGS. 1 through 12. Note that, an IC socket of the present embodiment can be connected to a circuit board under high temperature, for example, under 400° C. The IC socket is also easily replaced.

Figure 2:
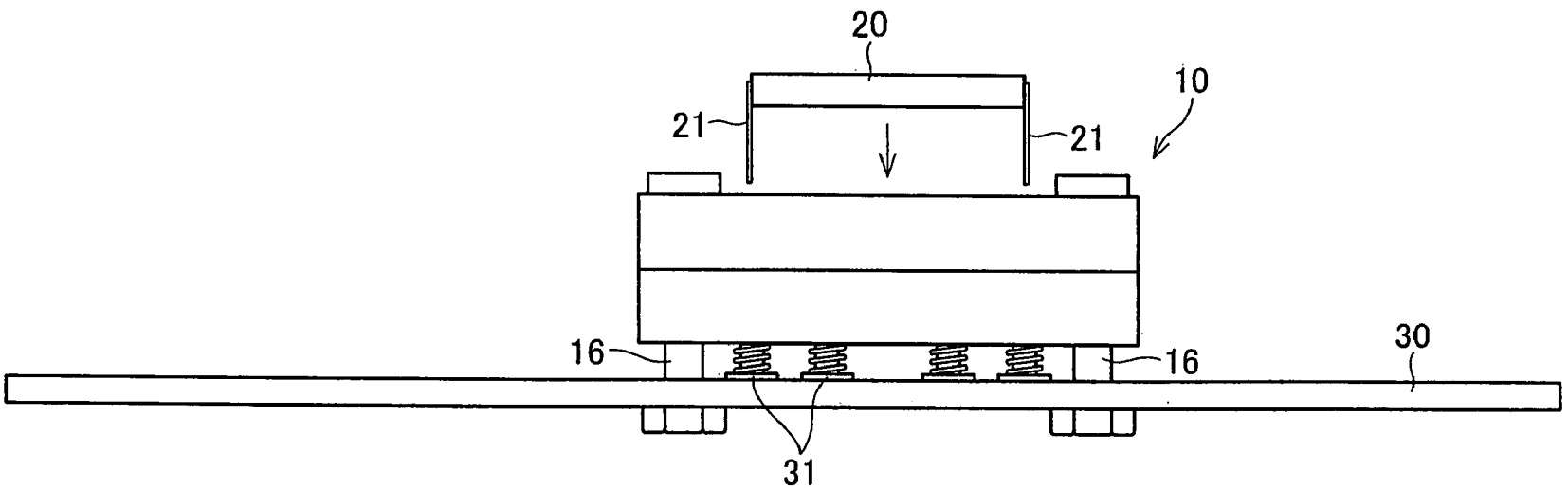
FIG. 2 is a lateral view showing a process of mounting an IC to the IC socket connected to a substrate.
Figure 3:
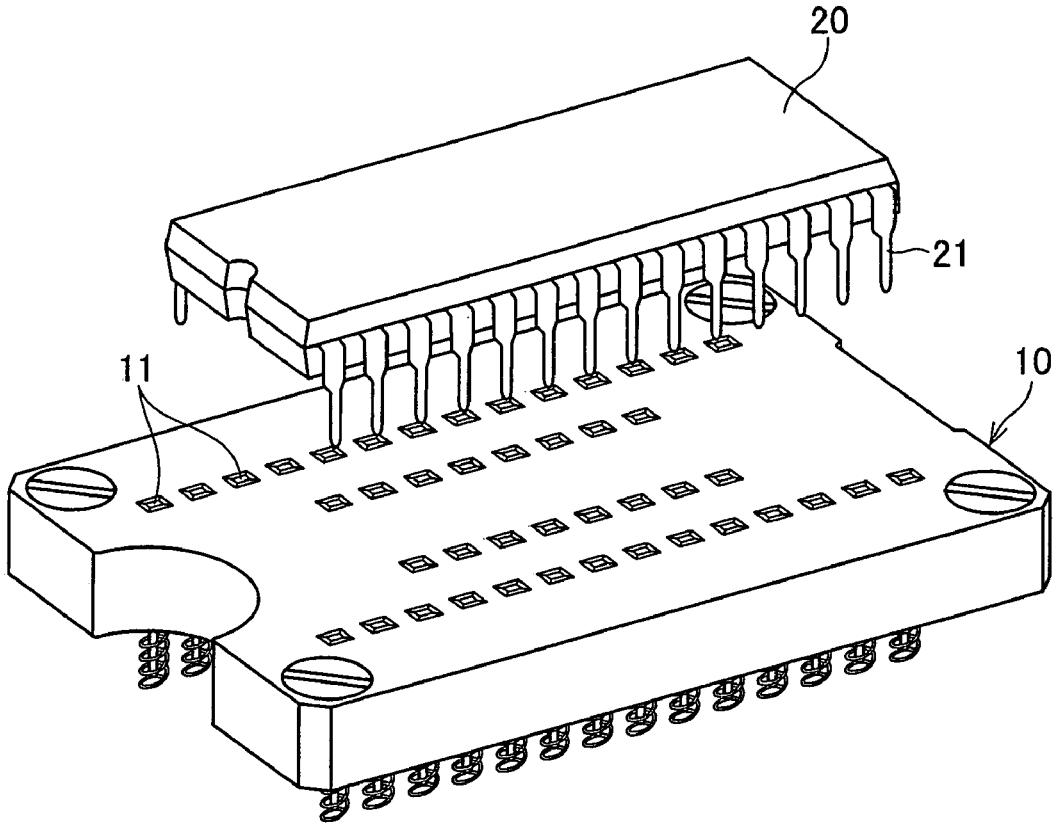
FIG. 3 is an oblique perspective view showing a structure of the IC socket and the IC.

As show in FIG. 2, the IC socket 10 of the present embodiment is used for electrically connecting a lead terminal 21 protruded from the IC 20 to a pad 31, which is an electrode of a circuit board 30. As shown in FIG. 3, a plurality of lead terminals 21 are protruded downward from two lateral sides and the center (not shown) of the IC 20. Further, as also shown in FIG. 4(*a*), the lead terminals 21 are respectively inserted into lead terminal insertion holes 11 formed on the surface of the IC socket 10.

Figure 5:
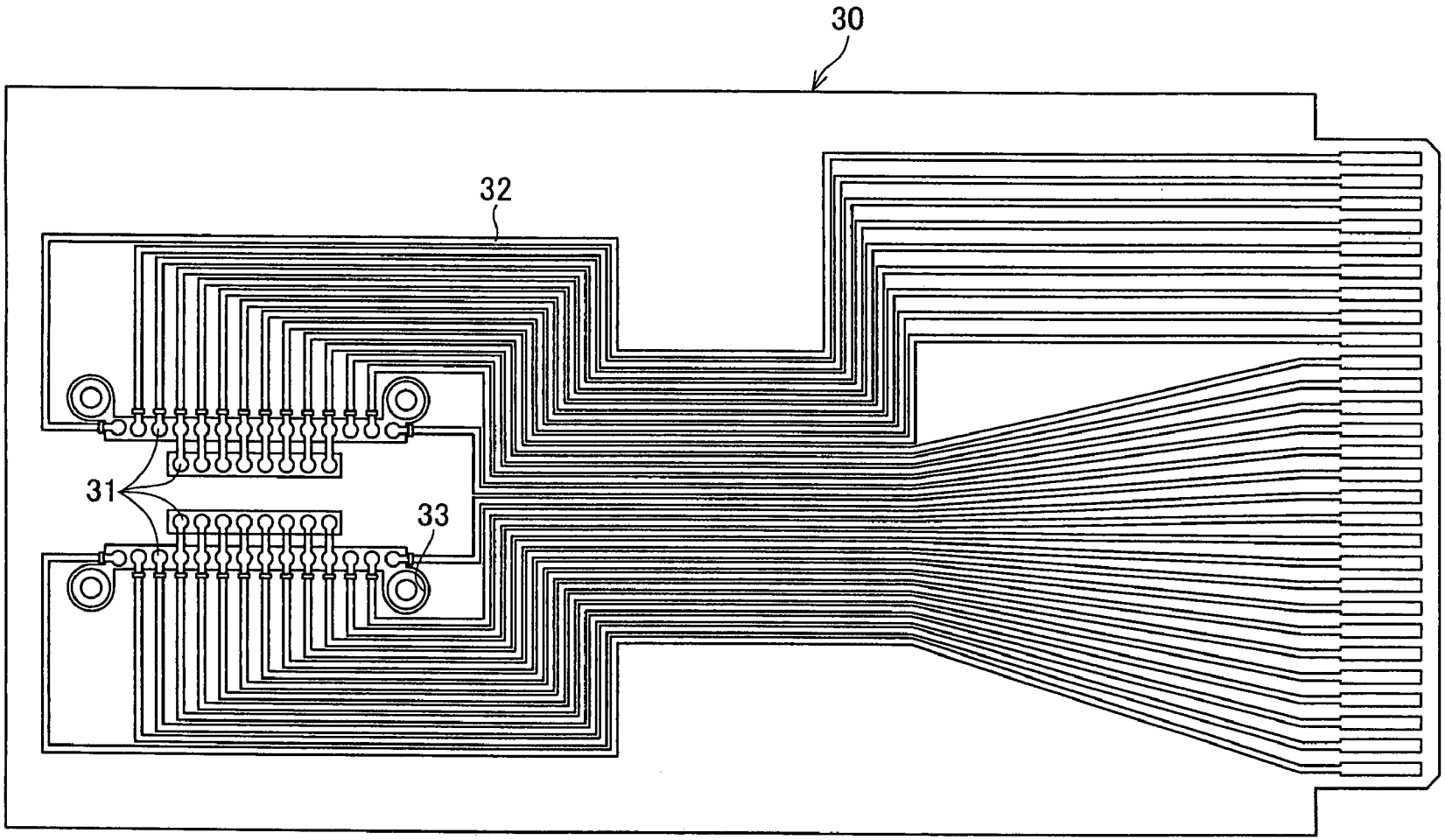
FIG. 5 is a plan view showing a structure of a substrate to which the IC socket is connected.

Meanwhile, as shown in FIG. 5, the circuit board 30 includes a plurality of pads 31 each of which is provided to be connected to one of the lead terminals 21. A wiring pattern 32 extends from each of the pads 31. The circuit board 30 is made of a metal resistant to high temperature, for example, 400° C., which is coated with a glass or ceramic. The pad 31 is printed thereon.

Figure 4:
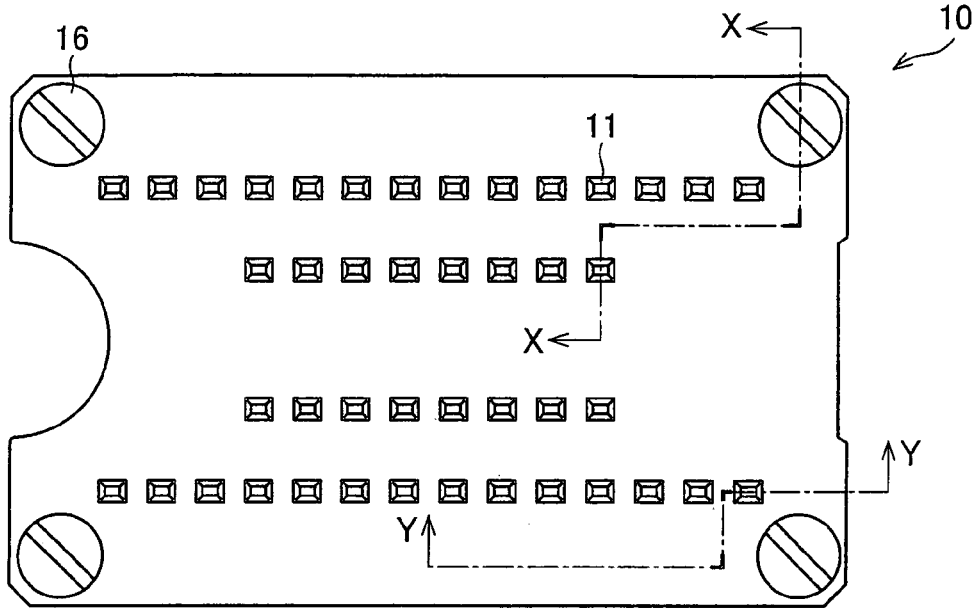
FIG. 4(*a*) is a plan view showing the IC socket.
Figure 4:
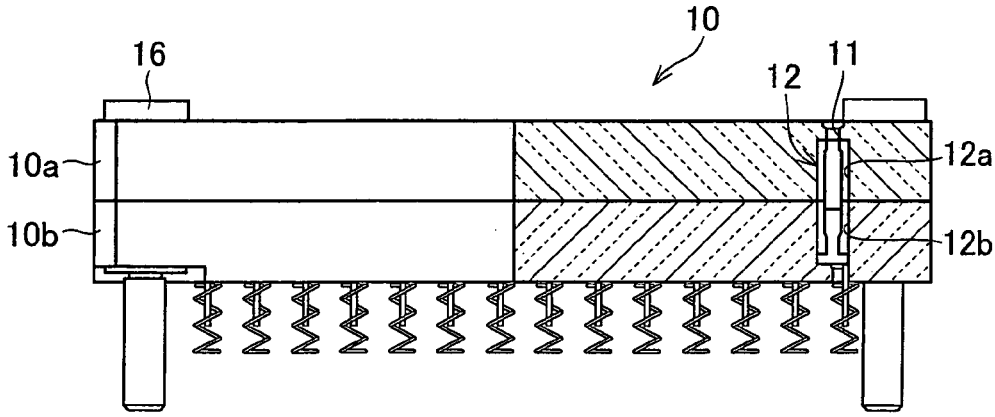
Figure 4:
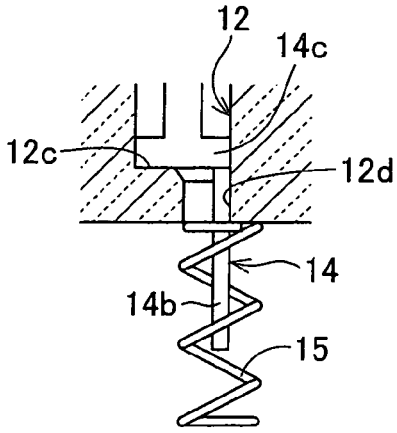

As shown in FIG. 4(*b*), an internal gap section 12 is formed inside the IC socket 10, which is a column-shaped depression section. Further, the internal gap section 12 includes the lead terminal insertion section 11, which extends from the upper end of the internal gap section 12 to the surface of the IC socket 10. Further, as shown in FIG. 4(*c*), the IC socket 10 also includes a contact pin exposing hole 12*d*, which extends from the lower end of the internal gap section 12 to the rear face of the IC socket 10.

Figure 6:
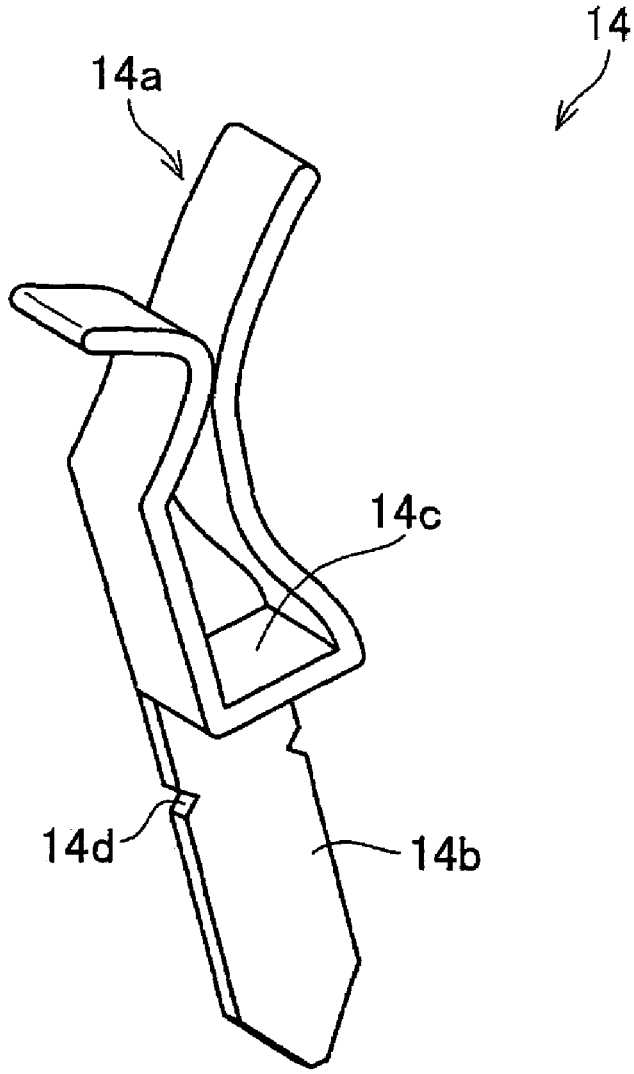
FIG. 6 is an oblique perspective view showing a structure of an IC socket conductive section of the IC socket.

As shown in FIG. 6, the internal gap section 12 serves as a room to contain a socket conducting section 14 which serves as a connecting section. The socket conducting section 14 is made of metal, and includes on an upper portion a holding section 14*a* for holding the lead terminal 21 of the IC 20, and on a lower portion a contact pin 14*b* which is to be in contact with the pad 31 of the circuit board 30.

The holding section 14*a* is made of a curved metal band having substantially a U-shape. The respective free ends of the holding section 14*a* are brought into contact with each other, so as to hold the lead terminal 21 of the IC 20 therebetween. Further, the bottom of the U-shape of the holding section 14*a* forms a horizontal pedestal section 14*c*, and the contact pin 14*b* made of a metal plate and having a chevron sharp front end is hung downward from the holding section 14*a*.

As shown in FIG. 4(*c*), the pedestal section 14*c* is placed on a bottom section 12*c* of the internal gap section 12.

Because of this structure in which the pedestal section 14*c* of the socket conducting section 14 is placed on the bottom section 12*c* of the internal gap section 12, as shown in FIG. 4(*b*), the IC socket 10, which is the main body of the IC socket, is constituted of an upper main body section 10*a* as an upper socket body and a lower main body section 10*b* as a lower socket body. When the socket conducting section 14 is contained in the internal gap section 12, the upper main body section 10*a* and the lower main body section 10*b* are separated from each other. Then, after the pedestal section 14*c* of the socket conducting section 14 is placed on the bottom section 12*c* of the internal gap section 12 of the lower main body section 10*b*, the upper main body section 10*a* is placed thereon, so that the socket conducting section 14 is contained in the internal gap section 12 of the IC socket 10.

As shown in FIGS. 4(*c*), 1(*a*) and 1(*b*), the socket conducting section 14 of the present embodiment is laid out such that the coil spring 15 is winded around the contact pin 14*b* of the socket conducting section 14. The coil spring 15 is made of a gold-plated wire, and serves to reduce the electric resistance between the IC socket and the pad 31. Note that, in the present invention, the coil spring 15 may be other kind of conductive wire than the gold-plated wire.

The coil spring 15 is attached and fixed to the contact pin 14*b* at the upper end of the contact pin 14*b*, making electrical conduction between the contact pin 14*b* and the coil spring 15. Further, when the coil spring 15 is expanded, its free end extends beyond the position of the front end of the contact pin 14*b*.

Note that, in the present embodiment, the contact pin 14*b* includes a groove section 14*d*, which allows the coil spring 15 to be fixed to the contact pin 14*b* of the socket conducting section 14. This arrangement eases mounting of the coil spring 15 to the socket conducting section 14. Further, as shown in FIG. 4(*a*) and FIG. 5, the bolt holes 33 are formed in the four corners of the IC socket 10 and in the corresponding portions of the circuit board 30, and the bolt holes 33 of the IC socket 10 and the bolt holes 33 of the circuit board 30 are respectively connected by bolts 16, so as to fix the IC socket 10 to the circuit board 30.

The following explains a method of mounting the foregoing IC socket 10 to the circuit board 30.

First, the upper main body section 10*a* and the lower main body section 10*b* of the IC socket 10, which are shown in FIG. 4(*b*), are separated from each other. Then, the contact pin 14*b* of the socket conducting section 14 is inserted into the contact pin exposing hole 12*d* under the lower internal gap section 12*b*, which is a depression section of the lower main body section 10*b*, and the pedestal section 14*c* of the socket conducting section 14 is placed on the bottom section 12*c* of the lower internal gap section 12*b*. Next, the upper main body section 10*a* is placed on the lower main body section 10*b* by engaging the holding section 14*a* of the socket conducting section 14 with the upper internal gap section 12*a*, which is a depression section of the upper main body section 10*a*.

Figure 7:
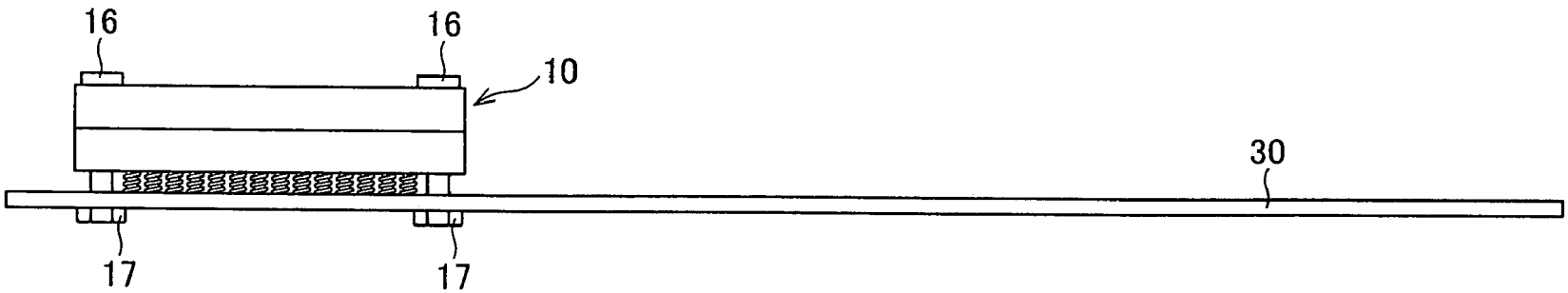
FIG. 7 is a front view of an IC socket connected to the substrate.

Next, as shown in FIG. 7, the bolt 16 is inserted from the upper end of the IC socket 10 and penetrates through the IC socket 10 and the circuit board 30, and its bottom end is fixed by a nut 17. As a result, the coil spring 15 is brought into contact with the pad 31 of the circuit board 30, and the coil spring 15 is contracted by the screwed nut 17 while applying pressure on the pad 31. This makes the front end of the contact pin 14*b* to be brought into contact with the pad 31.

Next, as shown in FIGS. 2 and 3, the lead terminal 21 of the IC 20 is inserted into the lead terminal insertion hole 11 on the surface of the IC socket 10. As a result, the lead terminal 21 of the IC 20 is electrically connected to the pad 31 of the circuit board 30 via the IC socket 10.

Figure 1:
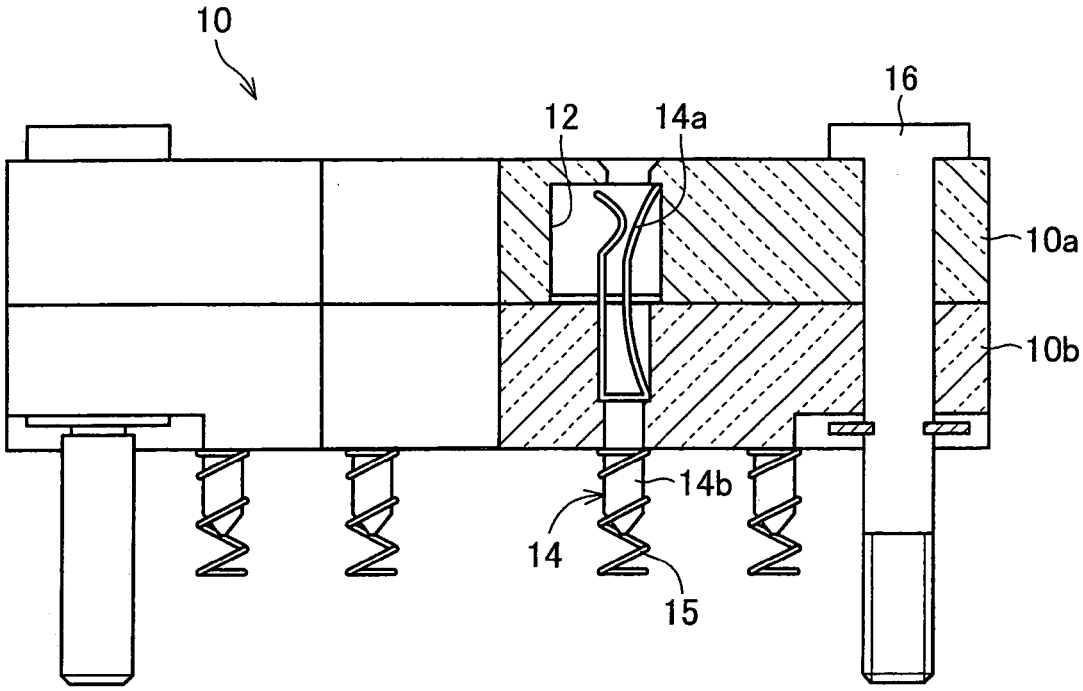
FIG. 1(*a*) is a cross-sectional view, taken along the line X-X of FIG. 4(*a*), showing an IC socket according to one embodiment of the present invention.
Figure 1:
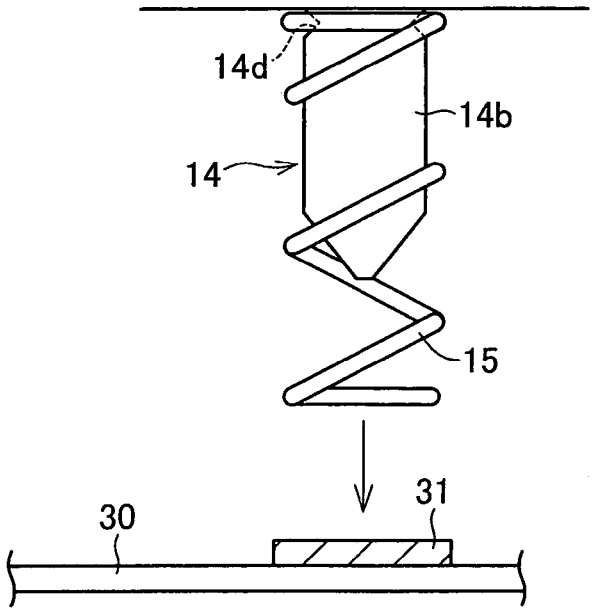

At this time, as shown in FIG. 1(*b*), the front end of the contact pin 14*b* of the socket conducting section 14 is brought into contact with the pad 31 of the circuit board 30, and also the entire end (plane) of the coil spring 15 is brought into contact with the pad 31. Therefore, the defect of contact failure is avoided.

Note that, though the foregoing explanation uses a coil spring 15, other kinds of spring may also be used in the present invention.

Figure 8:
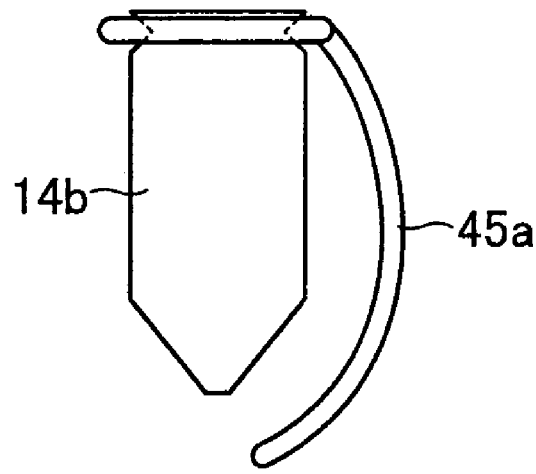
FIG. 8(*a*) is a front view showing a variation of coil spring.
Figure 8:
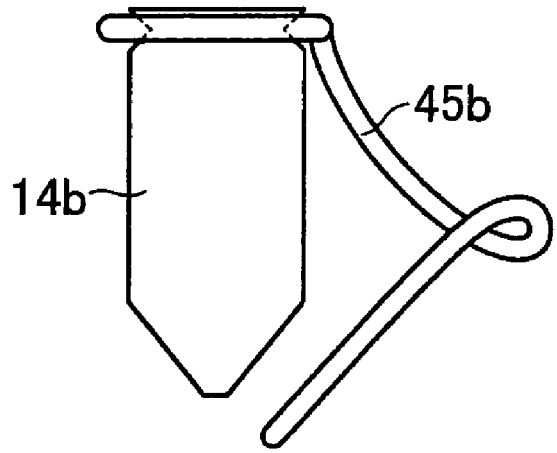

For example, as shown in FIGS. 8(*a*) and 8(*b*), linear springs 45*a* and 45*b* may be used instead of the coil spring. The linear spring 45*a* is made of an arcuate linear spring attached to the contact pin 14*b*. The linear spring 45*b* is made of a V-shaped linear spring attached to the contact pin 14*b*.

Meanwhile, the contact pin 14*b* in the foregoing explanation has rigidity, but an elastic contact pin may be used in the present invention.

Figure 9:
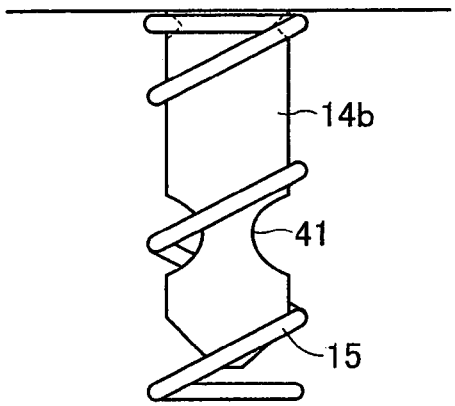
FIG. 9(*a*) is a front view showing a contact pin partly reduced in width.
Figure 9:
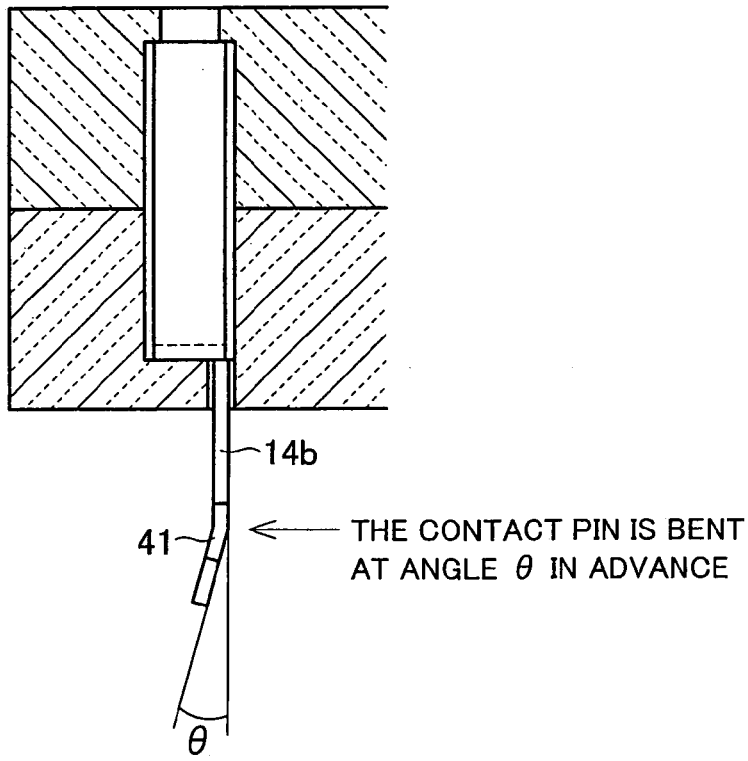

For example, as shown in FIG. 9(*b*), the contact pin 14*b* made of an elastic flat band may be bent at an angle θ at a certain intermediate portion. With this arrangement, when the contact pin 14*b* comes in contact with the pad 31, the contact pin 14*b* is curved, ensuring the connection between the contact pin 14*b* and the pad 31. Further, as shown in FIG. 9(*a*), this bent portion of the contact pin 14*b* preferably have a narrow-width section 41 which is reduced in width, with which the contact pin 14*b* can be easily curved.

Figure 10:
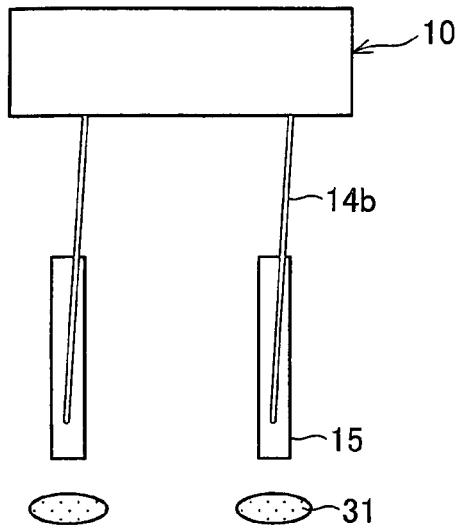
FIG. 10 is a front view showing an IC socket in which the contact pin is obliquely mounted.

Further, as shown in FIG. 10, the contact pin 14*b* may be obliquely attached to the IC socket 10 instead of vertically. This allows the contact pin 14*b* to be inclined when it is brought into contact with the pad 31, and the connection between the contact pin 14*b* and the pad 31 improves compared with the case where the contact pin 14*b* is vertically attached to the IC socket 10.

Figure 11:
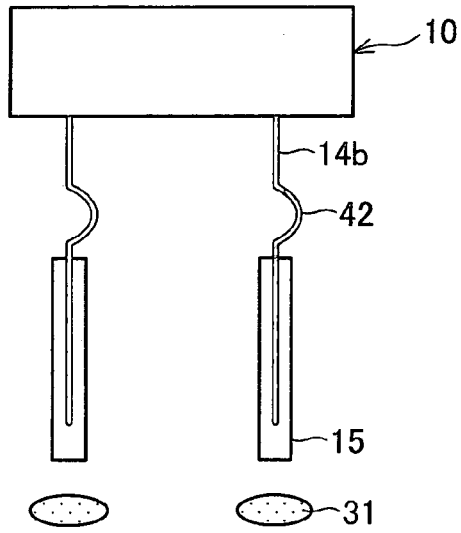
FIG. 11 is a front view showing a contact pin having a curve section.
Figure 12:
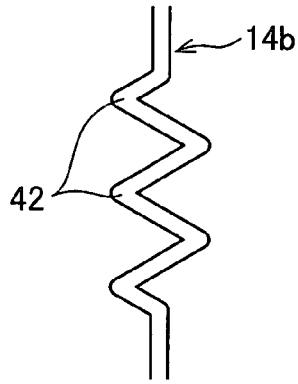
FIG. 12 is a front view of a contact pin having a plurality of curve sections.

Meanwhile, as shown in FIG. 11, the contact pin 14*b* may have a curve section 42, which makes the contact pin 14*b* elastic. Since the curve section 42 expands/contracts in the axis direction of the contact pin 14*b*, the connection between the contact pin 14*b* and the pad 31 is ensured. Further, the curve section 42 may be provided in plural portions of the contact pin 14*b*, as shown in FIG. 12. This improves the elasticity of the contact pin 14*b*.

As described, in the IC socket 10 of the present embodiment, the lead terminal 21 of the IC 20 is inserted into the holding section 14*a* of the socket conducting section 14 which serves as a connecting section of the IC socket 10. Meanwhile, a coil spring is fixed to each of the socket conducting sections 14 and protruded therefrom toward the circuit board 30. With this arrangement, the pad 31 of the circuit board 30 is brought into contact with the coil spring 15 with some pushing force, thereby bringing the pad 31 into contact with the coil spring 15 by an elastic force.

With this arrangement, even if the IC socket 10 includes plural coil springs 15 with varied lengths, all of the coil springs 15 are securely come in contact with the pad 31 of the circuit board 30. This is because the elasticity of spring reduces the defect of displacement by vibration or heat. The unevenness in connection condition is therefore eased.

Further, in the foregoing IC socket 10, the coil spring 15 is pressed on the pad 31 of the circuit board 30 without welding by silver (Ag) or in an electric manner. The IC socket 10 can be therefore easily replaced.

On this account, the IC socket 10 of the present invention allows easy replacement, and also is immune to the problem of inadequate contact with the circuit board 30.

Note that, the socket conducting section 14, which serves as a connecting section, does not always have to include the contact pin 14*b*. More specifically, even when the coil spring 15 is directly connected to the holding section 14*a* of the socket conducting section 14, the problem of inadequate connection between the IC socket 10 and the circuit board 30 is still prevented.

Further, in the IC socket 10 of the present embodiment, each of the socket conducting sections 14 includes a contact pin 14*b* protruded toward the circuit board 30, and each of the coil springs 15 is fixed to the contact pin 14*b*, being closer to the circuit board 30 than the contact pin 14*b*.

With this arrangement in which each of the coil springs 15 is fixed to the contact pin 14*b*, being closer to the circuit board 30 than the contact pin 14*b*, the problem of inadequate connection between the IC socket 10 and the circuit board 30 is prevented even in the conventional structure in which a plurality of contact pins 14*b* are protruded from the IC socket 10.

Further, when the respective springs, the coil spring 15 and the linear springs 45*a* and 45*b*, are brought into contact with the pad 31 due to an elastic force, the plural points, (i) the spring and (ii) the contact pin 14*b*, are in contact with the pad 31. Therefore, for example, even when some kind of deterioration, such as deformation of contact pin 14*b* by heat or generation of oxide film between the pad 31 and the contact pin 14*b*, the electrical conduction of the device is ensured.

Particularly, when the coil spring 15 is used as a spring part, the entire end of the coil spring is brought into contact with the pad 31 if it is moved by an elastic force of the spring, and therefore the connection failure of the entire device is very unlikely to occur. More specifically, since the connection between the IC socket 10 and the circuit board 30 is established at the point of the contact pin 14*b*, and also at the entire plane of the coil spring 15, it is possible to avoid the direct influence of the foregoing various deteriorations. Therefore, the connection condition is ensured in continuing use. The conduction reliability between the IC 20 and the circuit board 30 is thus guaranteed.

Further, in this structure, it is not necessary to accurately specify the length of the contact pin 14*b* so that all of the contact pins 14*b* are evenly come in contact with the pad 31. Therefore, this structure may be manufactured at lower cost.

Further, in the IC socket 10 according to the present embodiment, the holding section 14*a* of the socket conducting section 14 and the contact pin 14*b* are unified.

Therefore, with the use of the socket conducting section 14 which is made by unifying the holding section 14*a* which is connectable with the lead terminal 21 of the IC 20 and the contact pin 14*b* in contact with the circuit board 30, the number of componential members can be reduced.

Further, in the IC socket 10 according to the present embodiment, the IC socket is constituted of the upper main body section 10*a* and the lower main body section 10*b*, which respectively includes the upper internal gap section 12*a* and the lower internal gap section 12*b* into which the socket conducting section 14 is contained.

With this arrangement, the IC socket can be divided into the upper main body section 10*a* and the lower main body section 10*b* when the socket conducting section 14 is contained in the internal gap section 12, allowing the socket conducting section 14 to be easily contained in the upper main body section 10*a* and the lower main body section 10*b*.

Further, in the IC socket 10 according to the present embodiment, the contact pin 14*b* of the socket conducting section 14 has the groove 14*d* for fixing the coil spring 15 and the linear springs 45*a* and 45*b*.

With this arrangement, the coil spring 15 and the linear springs 45*a* and 45*b* can be easily fixed to the contact pin 14*b* by engaging the coil spring 15 and the linear springs 45*a* and 45*b* with the groove section 14*d*.

However, the present invention is not limited to this structure. For example, the coil spring 15 and the linear springs 45*a* and 45*b* may be welded into the contact pin 14*b*.

Further, in the IC socket 10 of the present invention, the contact pin 14*b* preferably has elasticity. On this account, the contact pin 14*b* and the pad 31 of the circuit board 30 are more securely connected.

Further, in the IC socket 10 of the present embodiment, the coil spring 15 and the linear springs 45*a* and 45*b* are preferably made of a gold-plated wire.

Because a gold-plated wire has a small electric resistance, it is possible to reduce electric resistance between the IC socket 10 and the pad 31 when they are conducted.

Second Embodiment

Figure 13:
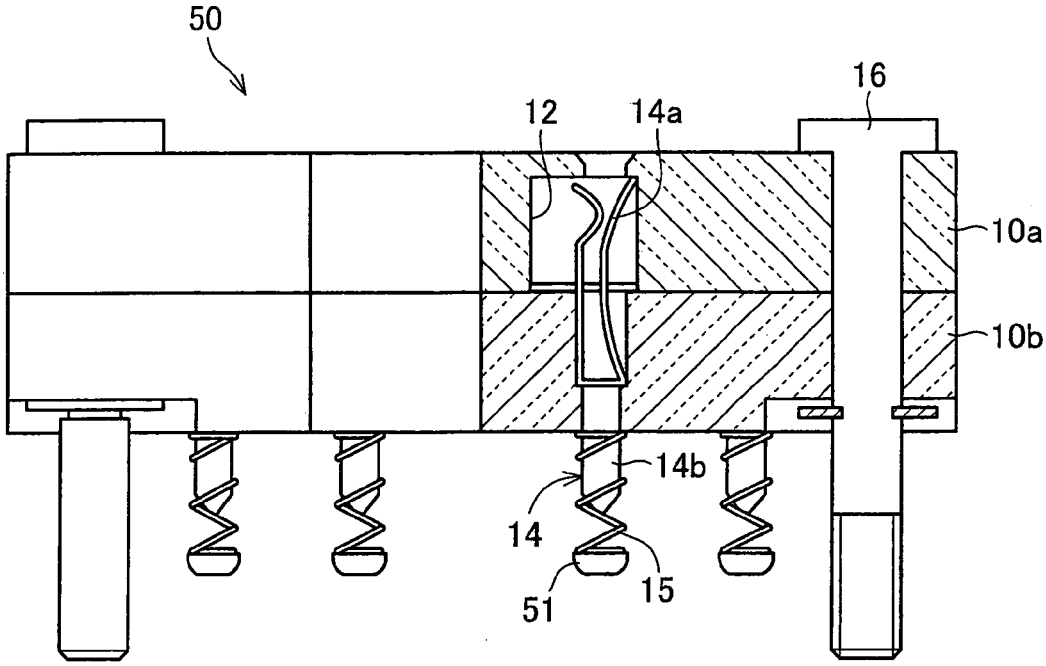
FIG. 13(*a*) is a cross-sectional view showing another embodiment of the IC socket of the present invention.
Figure 13:
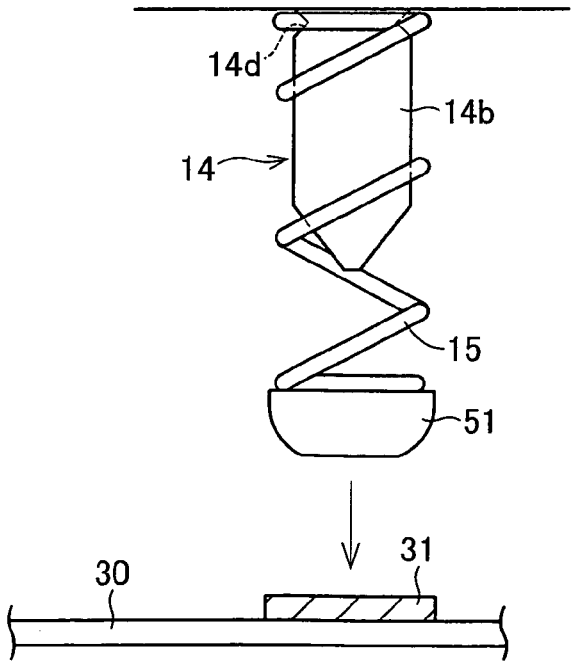
Figure 14:
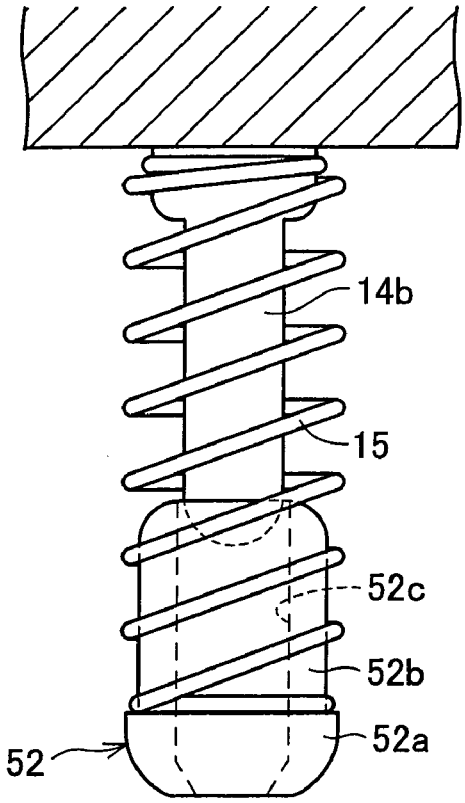
FIG. 14(*a*) is a magnified view of a main part of the IC socket, showing a structure of a column member having a through hole in its center, into which the contact pin is inserted.
Figure 14:
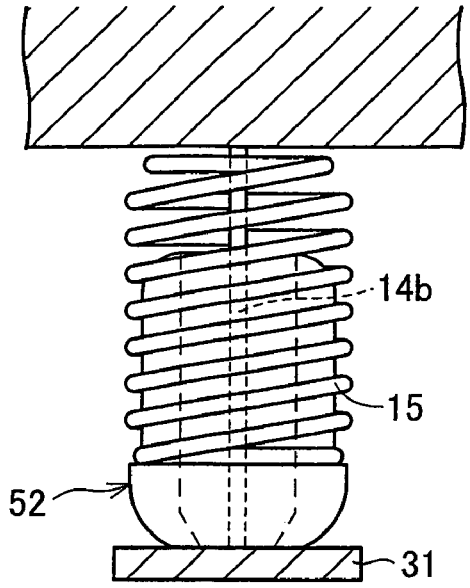
Figure 14:
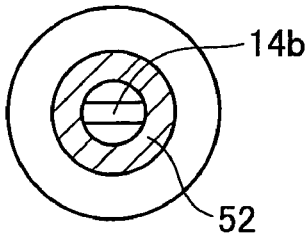
Figure 15:
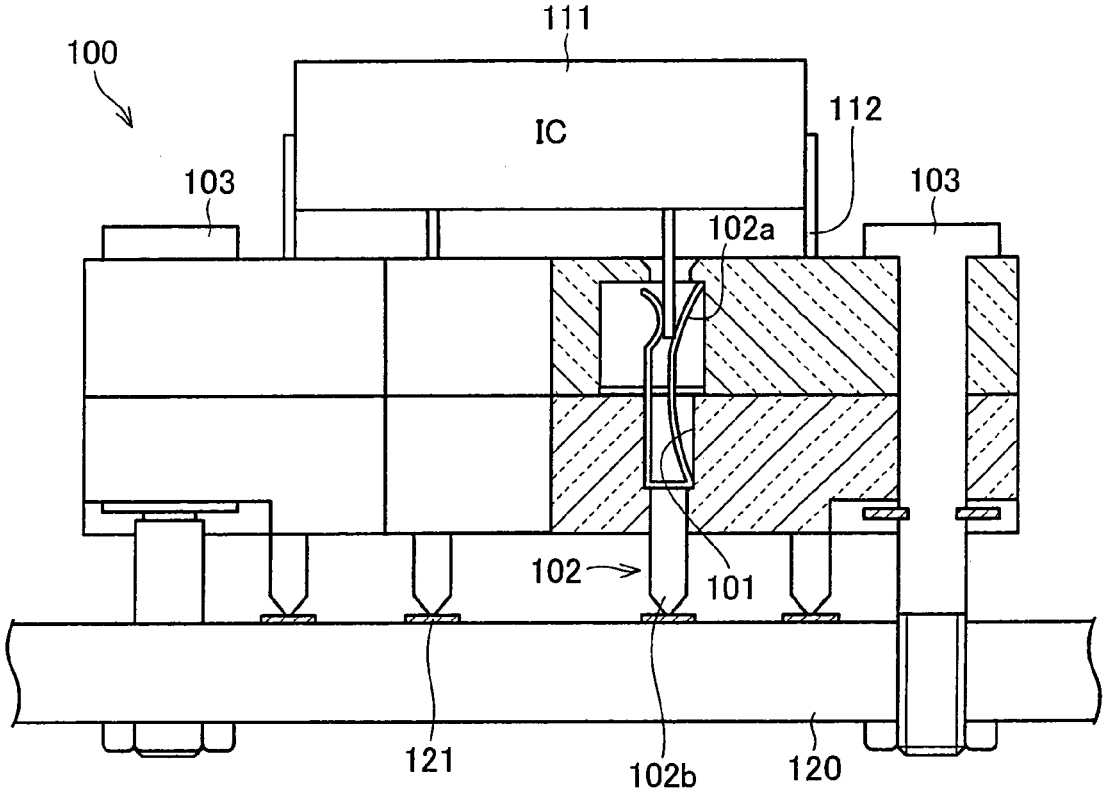
FIG. 15 is a cross-sectional view of a structure showing a conventional IC socket.
Figure 16:
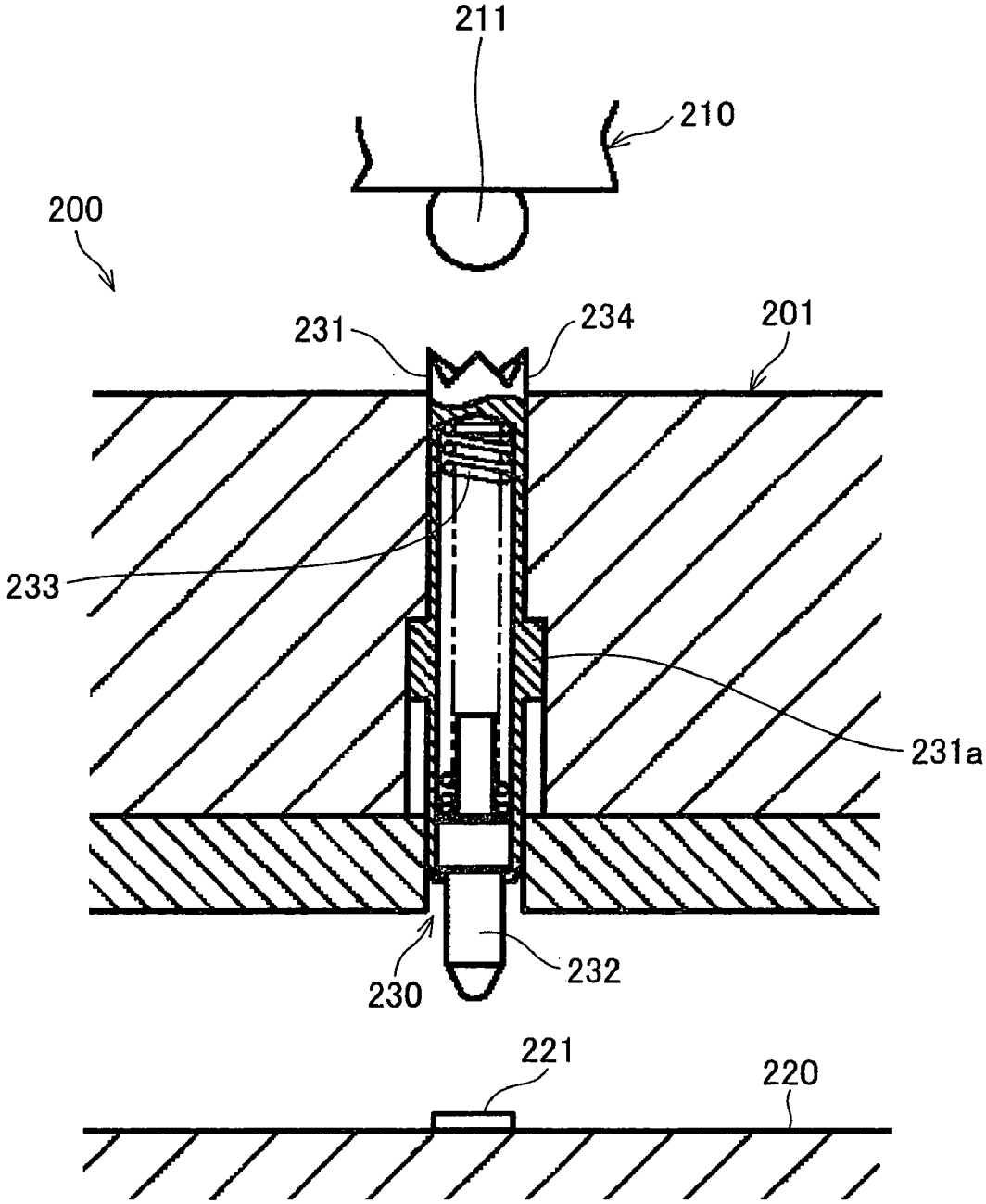
FIG. 16 is a cross-sectional view showing a structure of another conventional IC socket.

The following explains another embodiment of the present invention with reference to FIGS. 13 and 14. For ease of explanation, materials having the equivalent functions as those shown in the drawings pertaining to the foregoing First Embodiment will be given the same reference symbols, and explanation thereof will be omitted here.

As shown in FIGS. 13(*a*) and 13(*b*), in contrast to the IC socket 10 of First Embodiment, the IC socket 50 of the present embodiment additionally includes a column member 51 on the coil spring 15. In the coil spring 15, the column member 51 is fixed to the end closer to the circuit board 30.

More specifically, in contrast to the IC socket 10 of First Embodiment in which the coil spring 15 serves as a contacting object, the IC socket 50 of the present embodiment uses the column member 51 attached to the front end of the coil spring 15 as a contacting object. Note that, the shape of the column member 51 is not limited to the accurate cylinder, for example, the front corners may be rounded. The column member 51 is fixed to the coil spring 15, thereby establishing electrical conduction between the coil spring 15 and the column member 51. As in First Embodiment, the coil spring 15 is fixed by welding or the like on the upper end of the contact pin 14*b* of the socket conducting section 14, thereby electrically conducting the contact pin 14*b* and the coil spring 15.

With this arrangement, as shown in FIG. 13(*b*), the entire end (plane) of the column member 51 comes in contact with the pad 31. In this case, the contact area is larger than the case where the electrical conduction is made between the coil spring 15 and the pad 31. Therefore, even if the components are deformed due to high temperature, the contact failure is not likely to occur.

Note that, though the column member 51 is fixed by welding or the like on the front end of the coil spring 15 in the foregoing example, the present invention is not limited to this arrangement. For example, as shown in FIGS. 14(*a*) and 14(*b*), the column member 51 may instead be a column member 52 having the coil spring 15 winded thereon.

More specifically, the column member 52 includes a contacting object section 52*a* and a spring winding section 52*b*. The coil spring 15 is winded around the outer face of the spring winding section 52*b*, thereby fixing the column member 52 to the coil spring 15.

With this arrangement, the column member 52 is accurately vertically brought into contact with the pad 31. Therefore, even if the components are deformed due to high temperature, the contact failure is not likely to occur.

Each end of the contacting object section 52*a* close to the circuit board 30 is a flat plane, which becomes the whole contact area between the column member 52 and the pad 31. Therefore, the contact area is larger than the case where the electrical conduction is made between the coil spring 15 and the pad 31. Therefore, even if the components are deformed due to high temperature, the contact failure is not likely to occur.

Further, as shown in FIGS. 14(*a*) and 14(*b*), a through hole 52*c* is provided in the center of the column member 52. The through hole 52*c* is a cylinder hole where the contact pin 14*b* is inserted. The internal diameter of through hole 52*c* is larger than the width of the plate constituting the contact pin 14*b*, therefore, the contact pin 14*b* is loosely engaged with the column member 52.

With this through hole 52*c*, as shown in FIG. 14(*c*), the front end of the contact pin 14*b* of the socket conducting section 14 is inserted into the through hole 52*c* of the column member 52 in response to contracting movement of the coil spring 15. Therefore, the movement of the column member to be brought into contact with the electrode makes the spring contract, and the contact pin is inserted into the through hole 52*c* of the column member 52. As a result, the column member moves in parallel with the contact pin. Therefore, the column member is accurately vertically brought into contact with the pad.

Note that, though the column member 52 in the foregoing example has the cylinder through hole 52*c*, the present invention is not limited to this arrangement. The through hole 52*c* may have any form as long as it loosely support the contact pin 14*b*. For example, the through hole may be a square column, or may have an irregular lateral side.

Further, though the column member 52 has the through hole 52*c* in the present embodiment, this hole where the contact pin 14*b* is inserted may be a non-penetrating hole.

Further, though the through hole 52*c* is formed in the center of the column member 52 in the present embodiment, the present invention is not limited to this arrangement. For example, the through hole 52 may be formed on an eccentric portion of the column member 52.

Further, in the IC socket 50 according to the present embodiment, the column member 51/52 preferably has a gold-plated surface.

With this arrangement, the gold-plating reduces electrical resistance, and thereby the electric resistance between the IC socket 50 and the pad 31 is further reduced.

Further, in the IC socket 50 according to the present embodiment, the coil spring 15 is preferably constituted of a gold plated wire.

With this arrangement, a gold-plated wire has a small electrical resistance, and thereby the electric resistance between the contact pin 14*b* and the column member 51/52 is further reduced.

As described, the IC socket according to the present invention is preferably arranged so that: the conductive connecting sections each having a contact pin protruded from the IC socket toward the circuit board, each of the conductive springs being fixed to the contact pin, and being closer to the circuit board than the contact pin.

With this arrangement in which the spring is fixed to the contact pin and is closer to the circuit board than the contact pin, the problem of inadequate connection between the IC socket and the circuit board is prevented even in the conventional structure in which a plurality of contact pins are protruded from the IC socket.

Particularly, when the respective springs are brought into contact with the electrode due to an elastic force, the plural points, (i) the spring and (ii) the contact pin, are in contact with the electrode. Therefore, for example, even when some kind of deterioration, such as deformation of contact pin by heat or generation of oxide film between the electrode and the contact pin, the electrical conduction of the device is ensured.

The IC socket according to the present invention is preferably arranged so that: each of the conductive spring is provided with a conductive column member on its end closer to the circuit board. With this arrangement, the contact area becomes larger than the case where the conduction between the IC socket and the circuit board is established by connecting the coil spring and the electrode.

Therefore, even if the components are deformed due to high temperature, the contact failure is not likely to occur.

Further, it is preferable that the column member includes a hole into which each of the conductive connecting sections is inserted, and the conductive spring is winded around an outer face of the column member.

With this hole, the movement of the column member to be brought into contact with the electrode makes the spring contract, and the contact pin is inserted into the hole of the column member. As a result, the column member moves in parallel with the contact pin. Therefore, the column member is accurately vertically brought into contact with the pad.

On this account, the IC socket is more securely fixed. Therefore, even if the components are deformed due to high temperature, the contact failure is not likely to occur.

Further, the IC socket according to the present invention is preferably arranged so that: the holding section of the conductive connecting section and the contact pin are integrated.

Therefore, with the use of the conducting section which is made by unifying the holding section which is connectable with the lead terminal of the IC and the contact pin in contact with the circuit board, the number of componential members can be reduced.

Further, the IC socket according to the present invention is preferably arranged so that: a main body of the IC socket is constituted of an upper IC socket body and a lower IC socket body separable from each other, and the upper IC socket body and the lower IC socket body are each include a depression section into which the conductive connecting section is contained.

With this arrangement, the IC socket can be divided into the upper main body and the lower main body when the conductive connecting section is contained in the depression section, allowing the conductive connecting section to be easily contained in the depression section.

The IC socket according to the present invention is preferably arranged so that: the contact pin of the conductive connecting section includes a groove for fixing the conductive spring.

With this arrangement, the spring can be easily fixed to the contact pin by engaging the spring with the groove.

Further, the IC socket according to the present invention is preferably arranged so that: the conductive spring is constituted of a gold plated wire.

Because a gold-plated wire has a small electric resistance, it is possible to reduce electric resistance between the IC socket and the electrode when they are conducted.

Further, it is preferable that: the column member has a gold-plated surface. With this arrangement, it is possible to further reduce electric resistance between the IC socket and the electrode when they are conducted.

Further, the IC socket according to the present invention is preferably arranged so that: the contact pin has elasticity. On this account, the contact pin and the circuit board are more securely connected.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. An IC socket comprising:

a plurality of conductive connecting sections each having a holding section for holding one of a plurality of lead terminals of an IC; and a plurality of conductive springs, which are protruded from the IC socket and respectively fixed to the conductive connecting sections, the conductive springs being closer to a circuit board than the conductive connecting sections, wherein the conductive springs are fixed to the conductive connecting sections so that both the conductive springs and the conductive connecting sections contact the circuit board.

2. The IC socket as set forth in claim 1, wherein:

the conductive connecting sections each having a contact pin protruded from the IC socket toward the circuit board, each of the conductive springs being fixed to the contact pin, and being closer to the circuit board than the contact pin.

3. The IC socket as set forth in claim 1, wherein:

each of the conductive springs is provided with a conductive column member on its end closer to the circuit board.

4. The IC socket as set forth in claim 3, wherein:

the column member includes a hole into which each of the conductive connecting sections is inserted.

5. The IC socket as set forth in claim 1, wherein: the holding section of the conductive connecting section and the contact pin are integrated.

6. The IC socket as set forth in claim 1, wherein:

a main body of the IC socket is constituted of an upper IC socket body and a lower IC socket body separable from each other, and the upper IC socket body and the lower IC socket body each include a depression section into which the conductive connecting section is contained.

7. The IC socket as set forth in claim 2, wherein:

the contact pin of the conductive connecting section includes a groove for fixing the conductive spring.

8. The IC socket as set forth in claim 1, wherein:

the conductive spring is constituted of a gold plated wire.

9. The IC socket as set forth in claim 3, wherein:

the column member has a gold-plated surface.

10. The IC socket as set forth in claim 2, wherein:

the contact pin has elasticity.

11. The IC socket as set forth in claim 1, wherein:

the conductive springs and the conductive connecting sections contact the circuit board when the conductive springs contact the circuit board.

12. The IC socket as set forth in claim 3, wherein:

the conductive spring is wound around an outer face of the column member.

13. An IC socket, comprising:

a plurality of conductive connecting sections each having a holding section for holding one of a plurality of lead tenninals of an IC;

a plurality of conductive springs, which protrude from the IC socket and are respectively fixed to the conductive connecting sections, the conductive springs being closer to a circuit board than the conductive connecting sections; and a plurality of conductive column members respectively fixed to protruding ends of the conductive springs;

wherein the column members are fixed to the springs, and the springs are fixed to the connecting sections so that both the connecting sections and the column members contact the circuit board.

* * * * *